US006304663B1

(12) United States Patent
Claes et al.

(10) Patent No.: US 6,304,663 B1
(45) Date of Patent: Oct. 16, 2001

(54) OTOPLASTIC FOR A HEARING AID

(75) Inventors: Rudi A. M. Claes; Joseph F. J. M. Beumers, both of Eindhoven (NL)

(73) Assignee: Beltone Netherlands B.V., Eindhoven (NL)

( * ) Notice: Subject to any disclaimer, the term of this patent is extended or adjusted under 35 U.S.C. 154(b) by 0 days.

(21) Appl. No.: 09/248,140

(22) Filed: Feb. 10, 1999

(30) Foreign Application Priority Data

Sep. 25, 1998 (EP) ..... 98203228

(51) Int. Cl.[7] ..... H04R 25/00

(52) U.S. Cl. ..... 381/322; 381/328; 181/130; 264/313

(58) Field of Search ..... 381/322, 328, 381/325; 181/130, 135, 129; 264/222, 279, 313, 494

(56) References Cited

U.S. PATENT DOCUMENTS 4,962,537 * 10/1990 Basel et al. ..... 381/324
5,006,055 * 4/1991 Lebisch et al. ..... 264/222
5,008,058 * 4/1991 Henneberger et al. ..... 264/222
5,654,530 * 8/1997 Sauer et al. ..... 181/130
5,784,471 * 7/1998 Bebenroth ..... 381/322
6,144,750 * 11/2000 Levin ..... 381/328

FOREIGN PATENT DOCUMENTS

0498592A2 8/1992 (EP) ..... H04R/25/00
3713578C1 5/1988 (NL) ..... H04R/25/02
WO8803740 5/1988 (WO) ..... H04R/25/02
WO9615179 5/1996 (WO) .

* cited by examiner

*Primary Examiner*—Curtis Kuntz
*Assistant Examiner*—Suhan Ni
(74) *Attorney, Agent, or Firm*—McCutchen, Doyle, Brown & Enerson LLP; David G. Beck

(57) ABSTRACT

An otoplastic for a hearing aid, which otoplastic is manufactured from a UV light-curable synthetic resin composition, in particular an acrylate composition, to which a ceramic filler including at least 50% by weight $Al_2O_3$ is added to improve the properties of the otoplastic.

16 Claims, 1 Drawing Sheet

OTOPLASTIC FOR A HEARING AID

FIELD OF THE INVENTION

The invention relates to an otoplastic for a hearing aid, which otoplastic comprises a UV light-cured synthetic resin composition.

The invention further relates to a method of manufacturing an otoplastic, in which method use is made of an UV light-curable synthetic resin composition which, after it has been introduced into a mould, is irradiated with UV light.

The invention also relates to a hearing aid provided with an otoplastic.

A method of manufacturing an otoplastic is disclosed in DE-A 3713578. In this known method, an individual otoplastic is manufactured by using a transparent mould which is made by using a model of an auditory duct of a patient. A polymerizable, UV light-curable synthetic resin, to which colorants with opaque properties are added so as to adjust the penetration depth of UV light, is poured into the mould, whereafter polymerization takes place under the influence of UV light. For the UV light-curable synthetic resin use is made of an acrylate/methacrylate.

An otoplastic thus obtained has a number of drawbacks. One of the drawbacks relates to its limited mechanical strength, as a result of which the otoplastic might easily fracture when it is dropped or knocked. In addition, the colorants used in the otoplastic often cause allergic reactions with patients, such as swelling, inflammation, redness of the ears and itching in the vicinity of the ears.

BACKGROUND OF THE INVENTION

It is an object of the invention to provide an otoplastic which does not have the above-mentioned drawbacks.

In order to achieve this object the otoplastic in accordance with the invention is characterized in that the UV light-cured synthetic resin composition is provided with a ceramic filler comprising at least 50% by weight $Al_2O_3$ (aluminum trioxide). Said otoplastic may be used in various types of hearing aids, such as behind-the-ear hearing aids and in-the-ear hearing aids. The otoplastic is a hollow envelope which, when used in a hearing aid, serves as a housing or a shell, dependent upon the type of hearing aid.

In experiments it has been found that an otoplastic in which the synthetic resin composition is provided with the desired quantity of said ceramic filler is very resistant to shocks caused by knocking or dropping the otoplastic, i.e., it is robust. In the course of the manufacture of the otoplastic, the $Al_2O_3$ used is also responsible for the setting of the penetration depth of UV light. As a result, the addition of a colorant to the synthetic resin composition can be omitted. In order to counteract allergic reactions, preferably, the otoplastic in accordance with the invention does not contain colorants.

In an embodiment of the invention a UV light-cured acrylate composition is employed as the light cured synthetic resin composition. A UV light-curable acrylate somposition provided with a ceramic filler containing at least 50% by weight $Al_2O_3$ has very suitable properties for use as the starting material for the manufacture of an otoplastic. Acrylates, to which a photoinitiator is added for the curing process, are colorless substances. After the addition of $Al_2O_3$ and, subsequently, curing, an otoplastic having a chalk-white surface is obtained. Due to its clinical effect, such a surface has the advantage that soilage is rapidly detected, which has a favorable effect on the hygienic use of the otoplastic which, in turn, favorably influences the service life of the otoplastic and hence of the hearing aid in which the otoplastic is employed.

In a further embodiment of the invention the content of the ceramic filler ranges between 1 and 10% by weight of the synthetic resin composition. It has been found that a UV light-curable synthetic resin composition, in particular an acrylate composition to which 1 to 10% by weight of a ceramic filler including at least 50% by weight $Al_2O_3$ are added, yields an otoplastic having a substantial mechanical strength. An optimum strength is obtained if the content of the ceramic filler is 5% by weight or substantially 5% by weight.

In a still further embodiment of the invention the ceramic filler comprises in addition to $Al_2O_3$ at least on of $SiO_2$, $TiO_2$ and $CaCO_3$. The degree to which $SiO_2$, $TiO_2$ and $CaCO_3$ are used, is determined by the desired properties of the otoplastic. Although the percentages may be varied within wide limits, for example, to define the penetration depth of UV light during curing, the percentages by weight are customarily close to five.

The method in accordance with the invention is characterized in that before the UV light-curable synthetic resin composition is introduced into the mould, a ceramic filler including at least 50% by weight $Al_2O_3$ is admixed with the synthetic resin composition. It should be noted that as used herein, the term UV light is to be understood to mean radiation originating from a radiation source having an emission maximum of (approximately) 360 mn. The otoplastic manufactured in accordance with the method of the invention has the above-mentioned properties and advantages. The method also has the advantage that it can be carried out using existing equipment which is known per se.

It is noted that EP-A 0498592 discloses a colored hearing-aid shell, which is manufactured from a visible light-curable synthetic resin composition including a filler of titanium oxide, silicon dioxide or potassium titanate, and a colorant. During curing said composition, visible light having a wavelength of 450 nm is used. Both the manufacturing method used and the resultant product differ, in essential features, from the method and the otoplastic in accordance with the invention.

Preferably, in the method in accordance with the invention, an UV light-curable acrylate composition is used as the synthetic resin composition. A suitable acrylate is, for example, a methacrylate or a urethane acrylate. Preferably, also a quantity of a ceramic filler in an amount of 1 to 10% by weight of the synthetic resin composition, in particular the UV light-curable acrylate composition, is added. To achieve optimum results, 5% by weight is preferred. At least one of the materials $SiO_2$, $TiO_2$, $CaCO_3$ may be added to the ceramic filler in order to influence, in accordance with the requirements, specific properties of the composition and/or the otoplastic to be manufactured.

The invention further aims at providing a hearing aid which is provided with a sturdy otoplastic and which is comfortable to use.

To achieve this, the hearing aid in accordance with the invention is provided with the otoplastic according to the invention or is manufactured in accordance with the method of the invention.

DETAILED DESCRIPTION OF THE INVENTION

Figure 1:
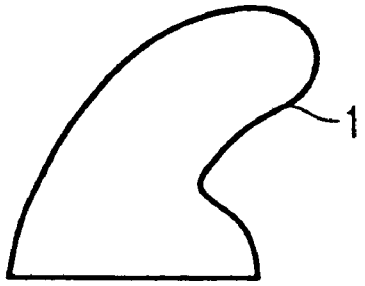
FIG. 1 is a diagrammatic, longitudinal sectional view of an embodiment of the otoplastic in accordance with the invention.

The invention will now describe in greater detail with reference of the figures of the drawing.

The otoplastic shown in FIG. 1 serves as a housing for an in-the-ear hearing aid. Said otoplastic is a hollow body 1 whose external shape is adapted to a patient's external auditory duct, particularly a part thereof situated near the eardrum. The otoplastic in this example is made from a UV light-curable acrylate composition which is provided with a ceramic filler including at least 50% by weight $Al_2O_3$, in this example approximately 70% by weight. The otoplastic is manufactured by means of a model of the external auditory duct. Such a model serves as the basis for making a mould in which said composition provided with ceramic filler is introduced. The composition, to which a suitable initiator is added for curing, is subsequently irradiated with UV light, in which process a layer of the composition bordering on the mould is cured so as to form the hollow body 1. The UV light is supplied by a radiation lamp having an emission maximum at 360 nm. After completion of the radiation process, the non-cured part of the composition is removed, and subsequently the moulded body 1 formed is cured further and removed from the mould.

Before the synthetic resin composition used in the method in accordance with the invention is introduced into the mould, it is admixed with a quantity of a ceramic filler, which quantity corresponds to 1 to 10% by weight, in this example approximately 5% by weight, of the synthetic resin composition. Apart from $Al_2O_3$, the ceramic filler may comprise additives such as $SiO_2$, $TiO_2$, $CaCO_3$.

Figure 2:
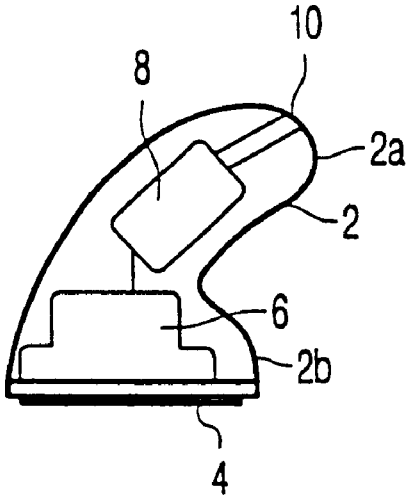
FIG. 2 is a diagrammatic, longitudinal sectional view of an embodiment of the hearing aid in accordance with the invention.

The in-the-ear hearing aid shown in FIG. 2 is provided with the otoplastic shown in FIG. 1. This otoplastic constitutes a housing 2 having a relatively thin wall. Said housing 2, which is closed by a mounting plate 4, accommodates components which are known per se, such as a microphone, an amplifier device 6, a battery and an electro-acoustic converter 8. In accordance with the shape of an auditory duct, the housing 2 has a relatively narrow portion 2*a* and a relatively wide portion 2*b*. In the portion 2*a*, there is an aperture 10 for guiding acoustic signals to the exterior, and in the portion 2*b* there is an aperture for guiding sound signals to the microphone.

It is noted that the invention is not limited to the examples shown herein. For example, the shape of the otoplastic may differ from that shown herein. Also, the hearing aid may be of a type which differs from the in-the-ear hearing aid.

What is claimed is:

1. An otoplastic for a hearing aid, which otoplastic comprises a UV light-cured synthetic resin composition, characterized in that the UV light-cured synthetic resin composition is provided with a ceramic filler comprising at least 50% by weight of $Al_2O_3$.

2. An otoplastic as claimed in claim 1, characterized in that the synthetic resin composition includes an UV light-cured acrylate composition.

3. An otoplastic as claimed in claim 1, characterized in that the ceramic-filler content in the synthetic resin composition ranges between 1 and 10% by weight.

4. An otoplastic as claimed in claim 3, characterized in that the ceramic-filler content is at least substantially 5% by weight.

5. An otoplastic as claimed in claim 1, characterized in that the ceramic filler comprises, in addition to $Al_2O_3$, at least one of the following materials: $SiO_2$, $TiO_2$ and $CaCO_3$.

6. An otoplastic as claimed in claim 2, characterized in that the ceramic-filler content in the synthetic resin composition ranges between 1 and 10% by weight.

7. An otoplastic as claimed in claim 6, characterized in that the ceramic-filler content is at least substantially 5% by weight.

8. An otoplastic as claimed in claim 2, characterized in that the ceramic filler comprises, in addition to $Al_2O_3$, at least one of the following materials: $SiO_2$, $TiO_2$ and $CaCO_3$.

9. A hearing aid comprising an otoplastic wherein the otoplastic comprises a UV light-cured synthetic resin composition, characterized in that the UV light-cured synthetic resin composition is provided with a ceramic-filler comprising at least about 50% by weight of $Al_2O_3$.

10. A hearing aid as claimed in claim 9, characterized in that the synthetic resin composition includes a UV light-cured acrylate composition.

11. A hearing aid as claimed in claim 9, characterized in that the ceramic-filler content in the synthetic resin composition ranges between about 1% and 10% by weight.

12. A hearing aid as claimed in claim 11, characterized in that the ceramic-filler content is at least substantially about 5% by weight.

13. A hearing aid as claimed in claim 9, characterized in that the ceramic-filler comprises, in addition to $Al_2O_3$, at least one of the following materials: $SiO_2$, $TiO_2$ and $CaCO_3$.

14. A hearing aid as claimed in claim 10, characterized in that the ceramic-filler contentin the synthetic resin composition ranges between about 1% and 10% by weight.

15. A hearing aid as claimed in claim 14, characterized in that the ceramic-filler content is at least substantially about 5% by weight.

16. A hearing aid as claimed in claim 10, characterized in that the ceramic-filler comprises, in addition to $Al_2O_3$, at least one of the following materials: $SiO_2$, $TiO_2$ and $CaCO_3$.

* * * * *